US009337946B2

(12) United States Patent
Eitan et al.

(10) Patent No.: US 9,337,946 B2
(45) Date of Patent: May 10, 2016

(54) DUAL-MODE LOW-NOISE BLOCK CONTROLLER

(71) Applicant: QUALCOMM Incorporated, San Diego, CA (US)

(72) Inventors: Alecsander P Eitan, Haifa (IL); Avigdor Brillant, Zichron Ya'akov (IL)

(73) Assignee: QUALCOMM Incorporated, San Diego, CA (US)

( * ) Notice: Subject to any disclaimer, the term of this patent is extended or adjusted under 35 U.S.C. 154(b) by 211 days.

(21) Appl. No.: 13/785,634

(22) Filed: Mar. 5, 2013

(65) Prior Publication Data

US 2014/0256246 A1 Sep. 11, 2014

(51) Int. Cl.

| | |
|---|---|
| ***H04H 40/90*** | (2008.01) |
| ***H04H 20/12*** | (2008.01) |
| *H04H 20/63* | (2008.01) |

(52) U.S. Cl.

CPC ..... *H04H 40/90* (2013.01); *H04H 20/12* (2013.01); *H04H 20/63* (2013.01); *H04H 2201/14* (2013.01)

(58) Field of Classification Search

CPC ..... H04H 40/90
USPC ..... 455/3.02
See application file for complete search history.

(56) References Cited

U.S. PATENT DOCUMENTS

| | | | | |
|---|---|---|---|---|
| 5,581,709 | A * | 12/1996 | Ito | G06F 13/4022 710/38 |
| 7,719,253 | B2 | 5/2010 | Fitzpatrick et al. | |
| 2005/0273821 | A1 | 12/2005 | Hundley | |
| 2011/0151769 | A1 | 6/2011 | Fitzpatrick | |
| 2011/0296470 | A1 * | 12/2011 | Kurten | 725/70 |
| 2014/0210545 | A1 * | 7/2014 | Leibowitz et al. | 327/540 |

FOREIGN PATENT DOCUMENTS

| | | | |
|---|---|---|---|
| DE | 19749120 | A1 | 6/1999 |
| JP | 2011239311 | A | 11/2011 |
| WO | WO 2006107871 | A2 * | 10/2006 |
| WO | 2006120203 | A2 | 11/2006 |
| WO | WO 2006120203 | A2 * | 11/2006 |

OTHER PUBLICATIONS

International Search Report and Written Opinion—PCT/US2014/018783—ISA/EPO—May 27, 2014.

* cited by examiner

*Primary Examiner* — Wesley Kim
*Assistant Examiner* — Dong-Chang Shiue
(74) *Attorney, Agent, or Firm* — Arent Fox LLP

(57) ABSTRACT

Exemplary embodiments are related to a dual-mode controller. A device may include a controller configured to convey a signal to a low-noise block (LNB) via a transmission line and circuitry configured to sense at least one parameter of the transmission line. The device may further include logic coupled to the circuitry and configured to determine whether the transmission line is available for transmission based on the at least one sensed parameter.

20 Claims, 10 Drawing Sheets

DUAL-MODE LOW-NOISE BLOCK CONTROLLER

BACKGROUND

1. Field

The present invention relates generally to low-noise block controllers. More specifically, the present invention relates to embodiments for controlling outdoor units of a satellite communication in a plurality of standards via a dual-mode low-noise block controller.

2. Background

Satellite communication may involve transmitting a signal to an orbiting satellite, which relays the signal back to various ground-based receivers. Accordingly, a subscribing unit, such as a household, may receive signals (i.e., audio and video signals) from a satellite via a receiver antenna (e.g., a satellite dish). A digital satellite communication system may include an outdoor unit (ODU), which is placed outside of a structure (e.g., a house, a business, or a vehicle). An ODU typically includes a satellite dish, a feedhorn, a low-noise block (LNB), and possibly a block up converter (BUC). The LNB may configured to receive a signal from the satellite collected by the satellite dish, amplify the signal, down-convert the signal to intermediate frequency (IF), and convey the down-converted signals to an indoor unit (IDU), which may include an indoor satellite TV receiver, a settop box, a personal computer (PC), a laptop computer, a media gateway, or any other device that can receive a feed from a satellite dish via a cable.

IDUs may be required to support several transport methods as well as ODU interface protocols and hardware deployments, such as Digital Satellite Equipment Control (DiSEqC) for satellite television, and UniCable, which can be used for satellite or terrestrial reception. Commercial LNB controllers support DiSEqC standard and/or UniCable standard. During use of a UniCable standard several client receivers share a common ODU via one RF cable and RF splitter. Further, it may not be possible for a client receiver within a communication system to detect if another client receiver is transmitting. Thus, if two receivers simultaneously transmit, commands may be lost (i.e., due to bus contention and data collisions).

A need exists for controlling ODUs of a communication system in a plurality of modes. More specifically, a need exists for systems, devices, and methods for a dual-mode LNB controller.

DETAILED DESCRIPTION

The detailed description set forth below in connection with the appended drawings is intended as a description of exemplary embodiments of the present invention and is not intended to represent the only embodiments in which the present invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. It will be apparent to those skilled in the art that the exemplary embodiments of the invention may be practiced without these specific details. In some instances, well-known structures and devices are shown in block diagram form in order to avoid obscuring the novelty of the exemplary embodiments presented herein.

Exemplary embodiments, as described herein, are directed to embodiments related to a dual-mode LNB controller. A device may include a controller configured to convey a signal to a low-noise block (LNB) via a transmission line and circuitry configured to sense at least one parameter of the transmission line. The device may further include logic coupled to the circuitry and configured to determine whether the transmission line is available for transmission based on the at least one sensed parameter. As will be appreciated by a person having ordinary skill in the art, the present invention may be applicable to satellite television and communication television networking in, for example, apartment buildings and hotels. Further, the present invention may be implemented within a satellite TV receiver, a settop box, a personal computer (PC), a laptop computer, a media gateway, or any other device that can receive a feed from a satellite dish via a cable.

Figure 1:
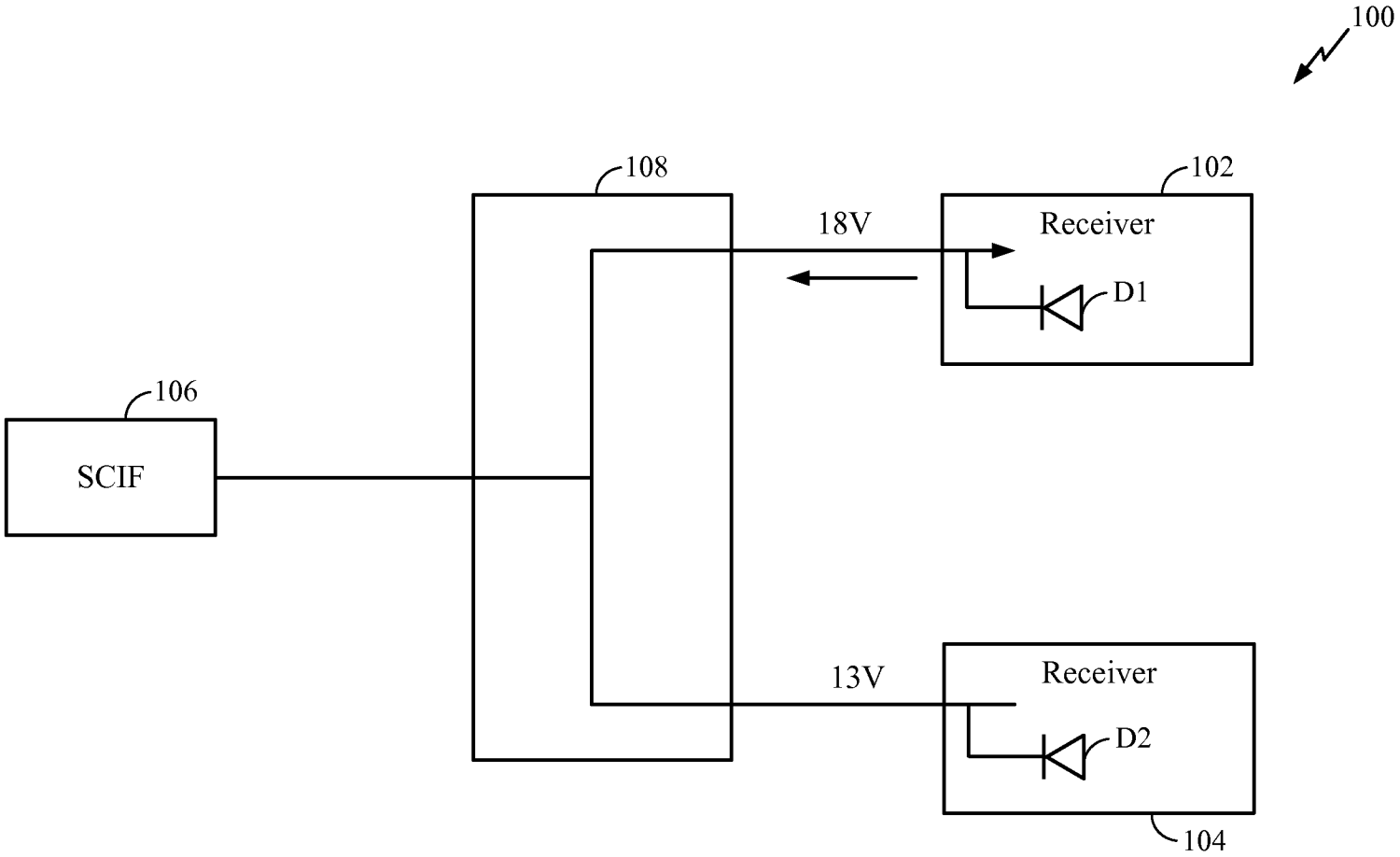
FIG. 1 illustrates a UniCable system.

An LNB controller, which may be part of an IDU, may provide power and control signals to and receive statuses from an ODU. UniCable standard supports a hardware concept where several users share a single ODU via a common transmission line (e.g., an RF cable and RF splitter) having a diode with an anode of the diode connected to a receiver. When UniCable receiver transmits, it asserts a supply voltage of approximately 18 volts. However, because the diodes (i.e., in each receiver or in the RF splitter) are reversed biased, other receivers may not detect the voltage assertion of a transmitting receiver and, thus, UniCable may be susceptible to bus contention FIG. 1 illustrates a UniCable system 100 wherein a first receiver 102 (i.e., within a first IDU) and a second receiver 104 (i.e., within a second IDU) are coupled to a single cable interface 106 via a UniCable splitter 108. As illustrated, first receiver 102 includes a diode D1 and second receiver 104 includes a diode D2. During operation of UniCable system 100, first receiver 102 (i.e., a transmitting receiver) may assert a first supply voltage (e.g., 18 volts) during a transmission mode (i.e., while transmitting a signal to an ODU). Further, second receiver 104 (i.e., a non-transmitting receiver) may assert a second supply voltage (e.g., 13 volts) during a non-transmission mode.

Figure 2:
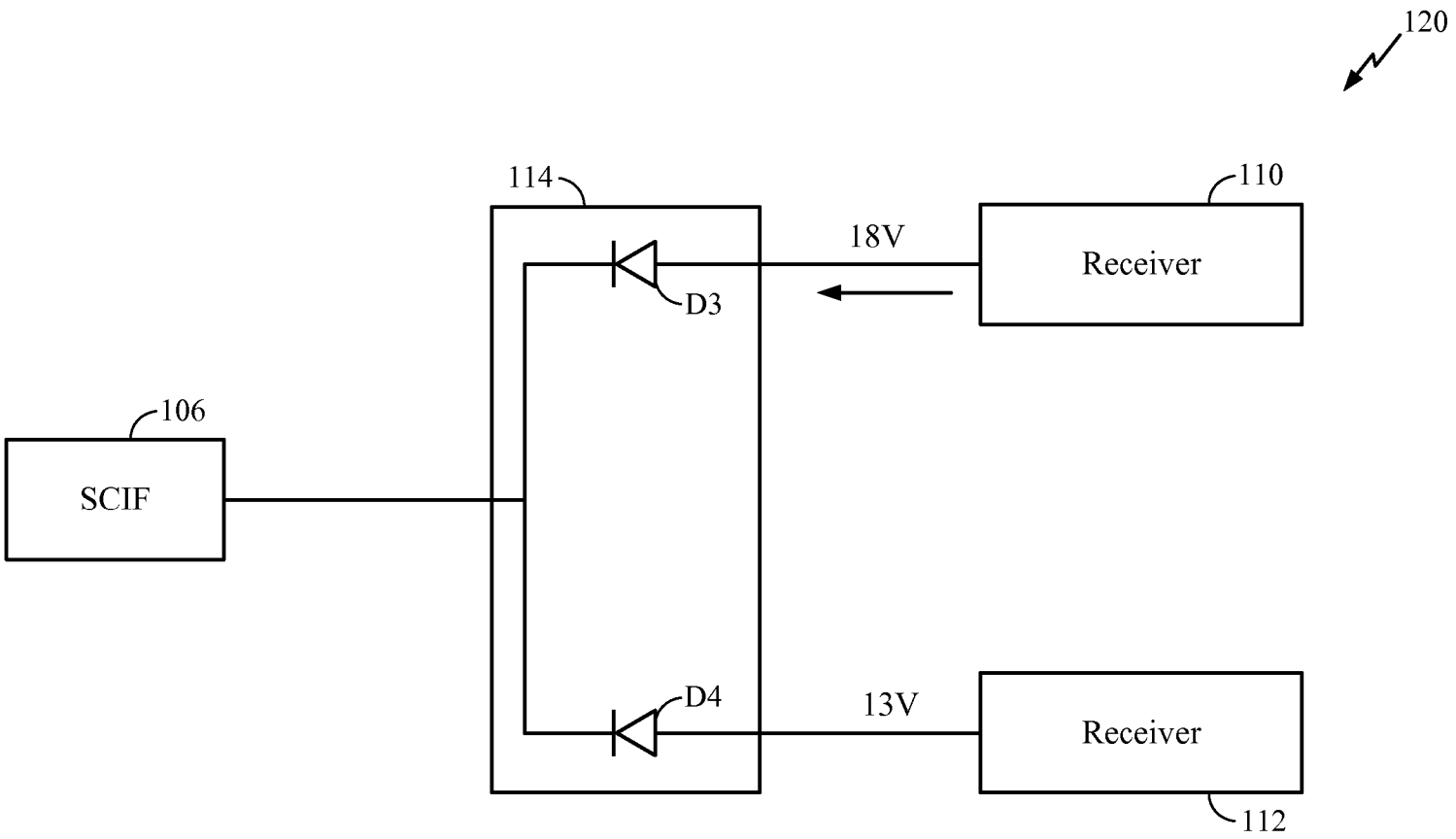
FIG. 2 illustrates another UniCable system.

FIG. 2 illustrates another UniCable system 120 including a first receiver 110 (i.e., within a first IDU) and a second receiver 112 (i.e., within a second IDU) coupled to single cable interface 106 via a UniCable splitter 114. As illustrated in FIG. 2, UniCable splitter 114 includes a diode D3 coupled between first receiver 110 and single cable interface 106 and a diode D4 coupled between second receiver 112 and single cable interface 106. During operation of UniCable system 120, first receiver 102 (i.e., a transmitting receiver) may assert a first supply voltage (e.g., 18 volts) during a transmission mode (i.e., while transmitting a signal to an ODU). Further, second receiver 104 (i.e., a non-transmitting receiver) may assert a second supply voltage (e.g., 13 volts) during a non-transmission mode.

As will be appreciated by a person having ordinary skill in the art, because of a reverse biased protection diode configuration of systems 100 and 120, bus contention and data collision may occur. Accordingly, a receiver, which is asserting a non-transmitting supply voltage (e.g. 13 volts), may not be able to detect transmission by another client receiver, which is asserting a transmitting supply voltage (e.g., 18 volts). Hence, the non-transmitting receiver may not be able to determine whether a BUS, which is shared by multiple receivers, is "busy" prior to sending a signal over the BUS. As a consequence, a BUS collision may exist.

Another problem with UniCable is a minimum current interrupt or a status bit assertion. As will be appreciated, conventional LNB controller circuits may sense a current supply to an ODU and generate an assertion when a current is low to indicate that the cable to an LNB is faulty. However, the receiver, which is at 13V, has an LNB controller with reverse bias protection diode (i.e., as shown in FIGS. 1 and 2) and, therefore, there is no current consumption. As a result the minimum current alarm may be asserted when standard DiSEqC LNB controller is used.

Figure 3:
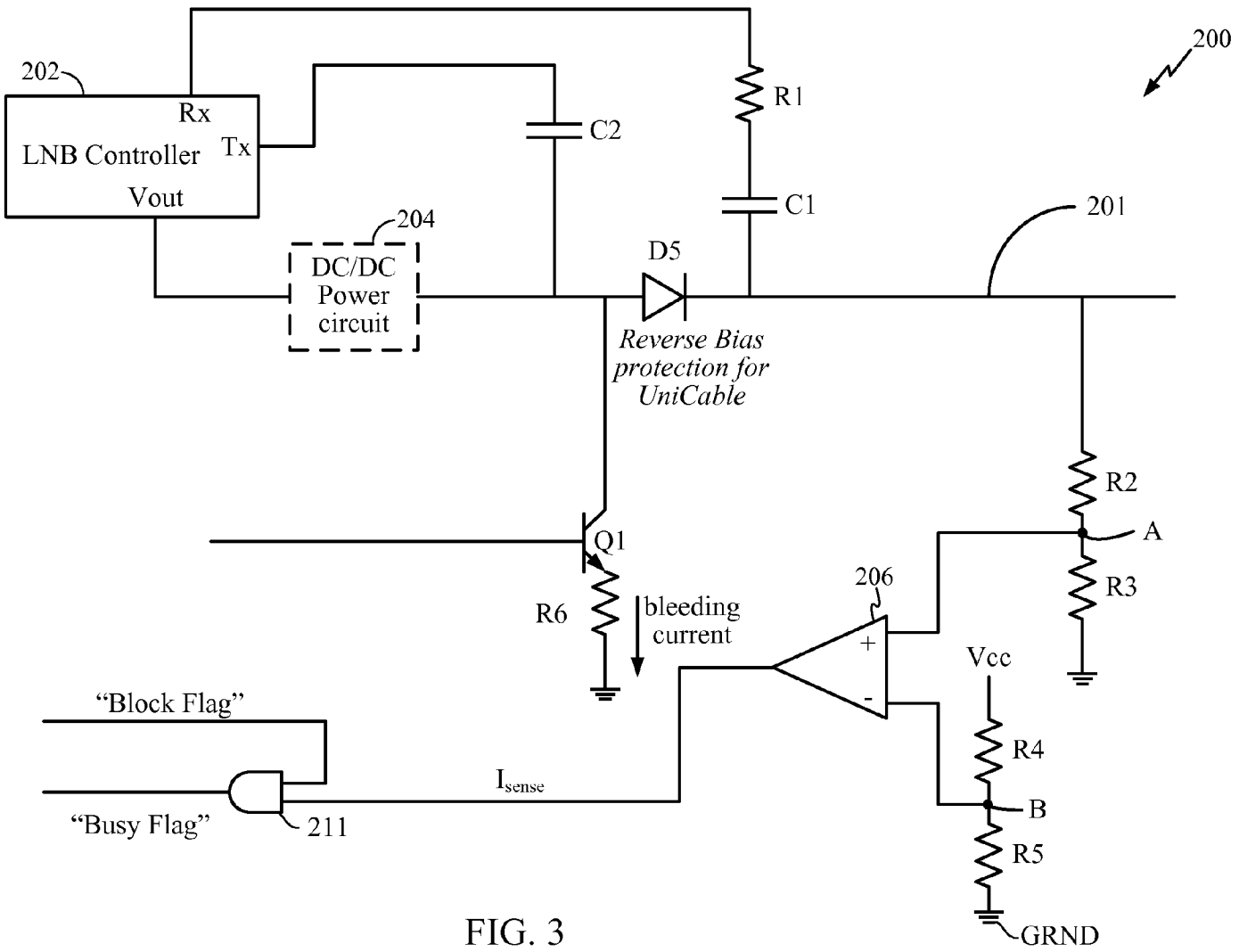
FIG. 3 illustrates a device including a controller for coupling to a low-noise block via a transmission line and circuitry for sensing a voltage on the transmission line, in accordance with an exemplary embodiment of the present invention.

FIG. 3 illustrates a device 200, according to an exemplary embodiment of the present invention. Device 200, which is configured for detecting transmission line activity, may be part of an IDU and includes an LNB controller 202 for coupling to an ODU via a transmission line 201. It is noted that the term "transmission line" as used herein, may also be referred to herein as a "BUS". Device 200 may include a DC/DC power circuit 204 and a diode D5. Further, in accordance with an exemplary embodiment of the present invention, device 200 may include circuitry for sensing a voltage at a cathode of diode D5. More specifically, device 200 may include a voltage sensing circuitry including resistors R2 and R3, and a reference voltage generator including resistors R4 and R5 coupled between a supply voltage Vcc and a ground voltage GRND. A node A, which is positioned between resistors R2 and R3, may be coupled to a port of a comparator 206, and a node B, which is positioned between resistors R4 and R5, may be coupled to another port of comparator 206. As will be appreciated by a person having ordinary skill in the art, comparator 206 may compare the voltage at node A to the voltage at node B and, in response to thereto, generate an output $I_{sense}$. The output of comparator 206 may be coupled to a port of a logic gate 211, which may comprise, for example only, a AND gate. Another port of logic gate 211 may be configured to receive a "Block Flag" signal. In order to prevent self interrupt while transmitting, device 200 may ignore an interrupt signal since it is creating the interrupt signal, or device 200 may mask the interrupt signal via logic gate 211 and setting the block flag signal to "0". It is noted that the block flag signal may default to "1" for detecting transmission activity of other receivers. An output of logic gate 211 is depicted as a "Busy Fag" signal, which may determine whether or not a DiSEqC command may be sent in UniCable mode.

Further, according to another exemplary embodiment of the present invention, device 200 includes a transistor Q1 coupled between an anode of diode D5 and a resistor R6, which is further coupled to ground voltage GRND. Resistor R6 may also be referred to herein as a "bleeding resistor." In response to receipt of a control voltage at a gate or base of transistor Q1, the anode of diode D5 may be coupled to ground voltage GRND via resistor R6. Thus, transistor Q1 may form a current bleeding path for use when diode D5 is reversed biased and, thus, false alarms may be reduced since, even though diode D5 is reversed bias because of another IDU transmission to an ODU, a bleeding current through bleeding resistor R6, which is only active in Unicable mode, may be sensed by LNB controller 202 and, thus, a false alarm (e.g., a low-current alarm or a IDU-ODU disconnect alarm) may be avoided. Stated another way, the bleeding current appears as ODU current consumption to LNB controller 202, and therefore, LNB controller 202 does not assert a false alarm.

LNB controller 202 includes a receiver port Rx, a transmit port Tx, and an output voltage port Vout. Receive port Rx is coupled to transmission line 201 via a resistor R1 and a capacitor C1, output voltage port Vout is coupled to DC/DC power circuit 204, which is further coupled to an anode of diode D5, and transmit port Tx is coupled to the anode of D5 via a capacitor C2.

During a contemplated operation of device 200, a voltage on transmission line 201 may be sensed via the voltage divider including resistors R2 and R3. The sensed voltage (i.e., the voltage at node A) may be compared via comparator 206 to a pre-determined reference voltage (i.e., the voltage at node B), which is generated via resistors R4 and R5, to determine whether transmission line 201 if "free" and thus, a DiSEqC transmission is allowed, or if transmission line 201 is "busy". For example, if the sensed voltage is less than or equal to the threshold voltage (e.g., 13 volts), the transmission line may be "free" and, thus, device 200 may transmit a DiSEqC command via transmission line 201. On the other hand, if the sensed voltage is greater than the threshold voltage, the transmission line may be "busy" and, device 200 may wait before attempting to transmit a DiSEqC command via transmission line 201.

It is noted that, according to one exemplary embodiment, LNB controller 202 may comprise an "off the shelf" LNB controller. According to another exemplary embodiment, as described more fully below, functionality of the voltage sense and current bleeding path circuits may be implemented within an LNB controller.

Figure 4:
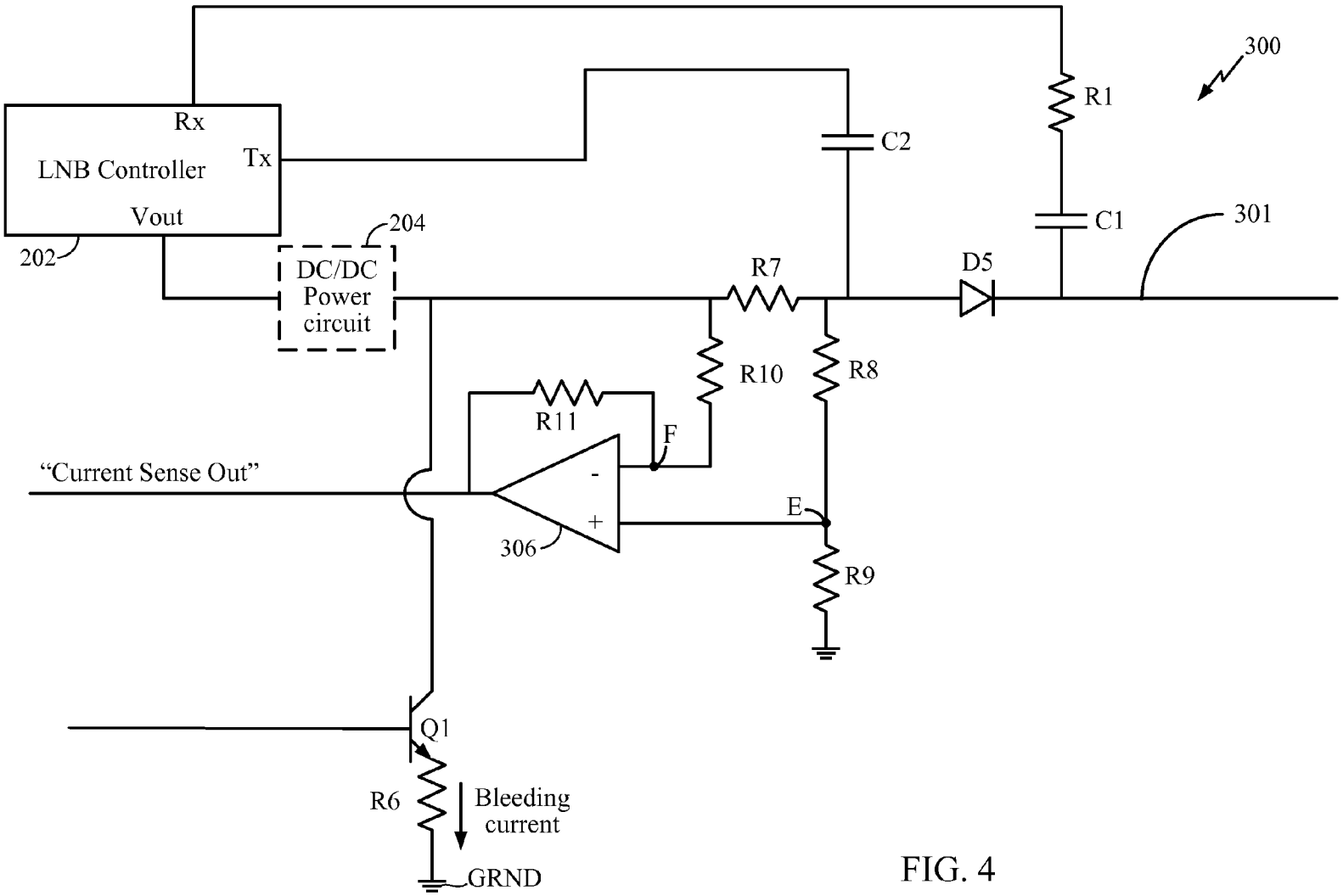
FIG. 4 illustrates device including a controller for coupling to a low-noise block via a transmission line and circuitry for sensing a current through the transmission line, according to an exemplary embodiment of the present invention.

FIG. 4 illustrates a device 300 including LNB controller 202 for coupling to an ODU via transmission line 301. Device 300 may include DC/DC power circuit 204 and diode D5. Further, in accordance with an exemplary embodiment of the present invention, device 300 may include circuitry for sensing a current through a resistor R7. More specifically, device 300 may include current sensing circuitry including resistors R7-R11 and a differential amplifier 306. As illustrated, a node E, which is positioned between resistors R8 and R9, may be coupled to a non-inverting input of differential amplifier 306, and a node F, which is coupled in between resistors R10 and R11, may be coupled to an inverting input of differential amplifier 306. Further, an output of differential amplifier 306 may be coupled to the inverting input of differential amplifier 306 via resistor R11. As will be appreciated by a person having ordinary skill in the art, differential amplifier 306 may be configured to compare the voltage at node E to the voltage at node F and, in response to thereto, generate an output "Current Sense Out", which may be proportional to the current through resistor R7. The output of differential amplifier 306 may be conveyed to an analog-to-digital converter (ADC) (not shown in FIG. 4) within a digital chip and a decision logic which defines whether transmission line 301 is busy or free based upon a pre-determined process, such as a process described below with reference to FIG. 8. Alternatively, the output of differential amplifier 306 may be conveyed to an analog comparator with a predetermined threshold which defines if the BUS is "free" or "busy". An output of the analog comparator may notify the digital chip if DiSEqC commands may be transmitted in an UniCable system.

Further, according to another exemplary embodiment of the present invention, device 300 includes transistor Q1 coupled between the anode of diode D5 and resistor R6, which is further coupled to ground voltage GRND. In response to receipt of a control voltage at a gate of transistor Q1, the anode of diode D5 may be coupled to ground voltage GRND via resistor R6. Thus, transistor Q1 may form a current bleeding path for use when diode D5 is reversed biased and, thus, false alarms may be reduced, as described above.

According to one contemplated operation of device 300, a current though resistor R7 in relation to an output voltage Vout conveyed via controller 202 may be monitored. More specifically, as one example, after a voltage output from controller 202 has been increased, the current through resistor R7 may be monitored via resistors R7-R11 and differential amplifier 306 to determine whether transmission line 301 if "free" and thus, a transmission is allowed, or if transmission line 301 is "busy". For example, if the current increases after the voltage is increased, the transmission line may be "free" and, thus, device 300 may transmit via transmission line 301. On the other hand, if the current does not increase after the voltage is increased, the transmission line may be "busy" and, device 300 may wait before attempting to transmit on transmission line 301.

It is noted that the current sensing circuitry may also be used to detect a collision that is caused by another IDU, which starts transmitting while device 300 is in the process of transmitting. According to one exemplary embodiment, upon detecting a collision (e.g., by detecting a change in current on transmission line 301), device 300 may stop transmitting data and, after a delay, may attempt to re-transmit the data. According to another exemplary embodiment, upon detecting a collision, device 300 may continue transmitting data and, after a delay, may re-transmit the data to be sure that the data was properly sent.

According to another contemplated operation of device 300, a current flowing though resistor R7 may be measured via resistors R7-R11 and differential amplifier 306 to determine whether transmission line 301 if "free" and thus, a DiSEqC transmission is allowed, or if transmission line 301 is "busy". For example, if the measured current is equal to or greater than a threshold current, the transmission line may be "free" and, thus, device 300 may transmit a DiSEqC command using transmission line 301. On the other hand, if the measured current is less than the threshold current, the transmission line may be "busy" and, device 300 may wait before attempting to transmit a DiSEqC command on transmission line 301.

As noted above, according to one exemplary embodiment, LNB controller 202 may comprise an "off the shelf" LNB controller. According to another exemplary embodiment, as described more fully below, functionality of the current sense and bleeding path circuits may be implemented within an LNB controller.

Figure 5:
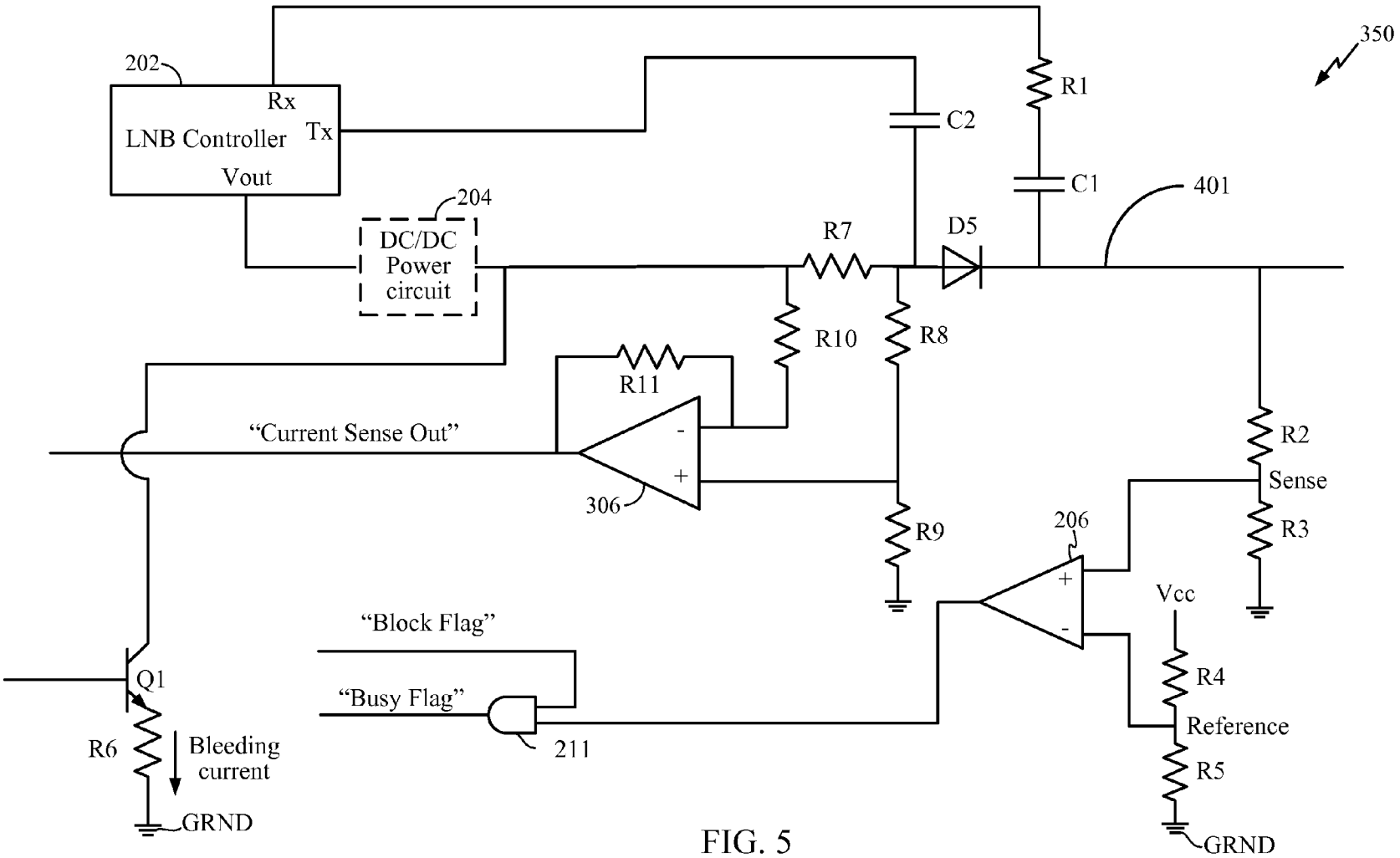
FIG. 5 illustrates device including a controller for coupling to a low-noise block via a transmission line and circuitry for sensing at least one parameter of the transmission line, according to an exemplary embodiment of the present invention.

FIG. 5 illustrates a device 350 including LNB controller 202 for coupling to an ODU (not shown in FIG. 5) via a transmission line 401. Device 350 may include DC/DC power circuit 204 and diode D5. Further, in accordance with an exemplary embodiment of the present invention, device 350 may include circuitry (i.e., resistors R3-R5 and comparator 206) for sensing a voltage on transmission line 401, as illustrated in device 200 and circuitry (i.e., resistors R7-R11 and differential amplifier 306) for sensing a current through resistor R7, as illustrated in device 300. Device 350 further includes circuitry (i.e., transistor Q1 and resistor R6) for forming a current bleeding path from coupled between DC/DC power circuit 204 and resistor R7.

Figure 6:
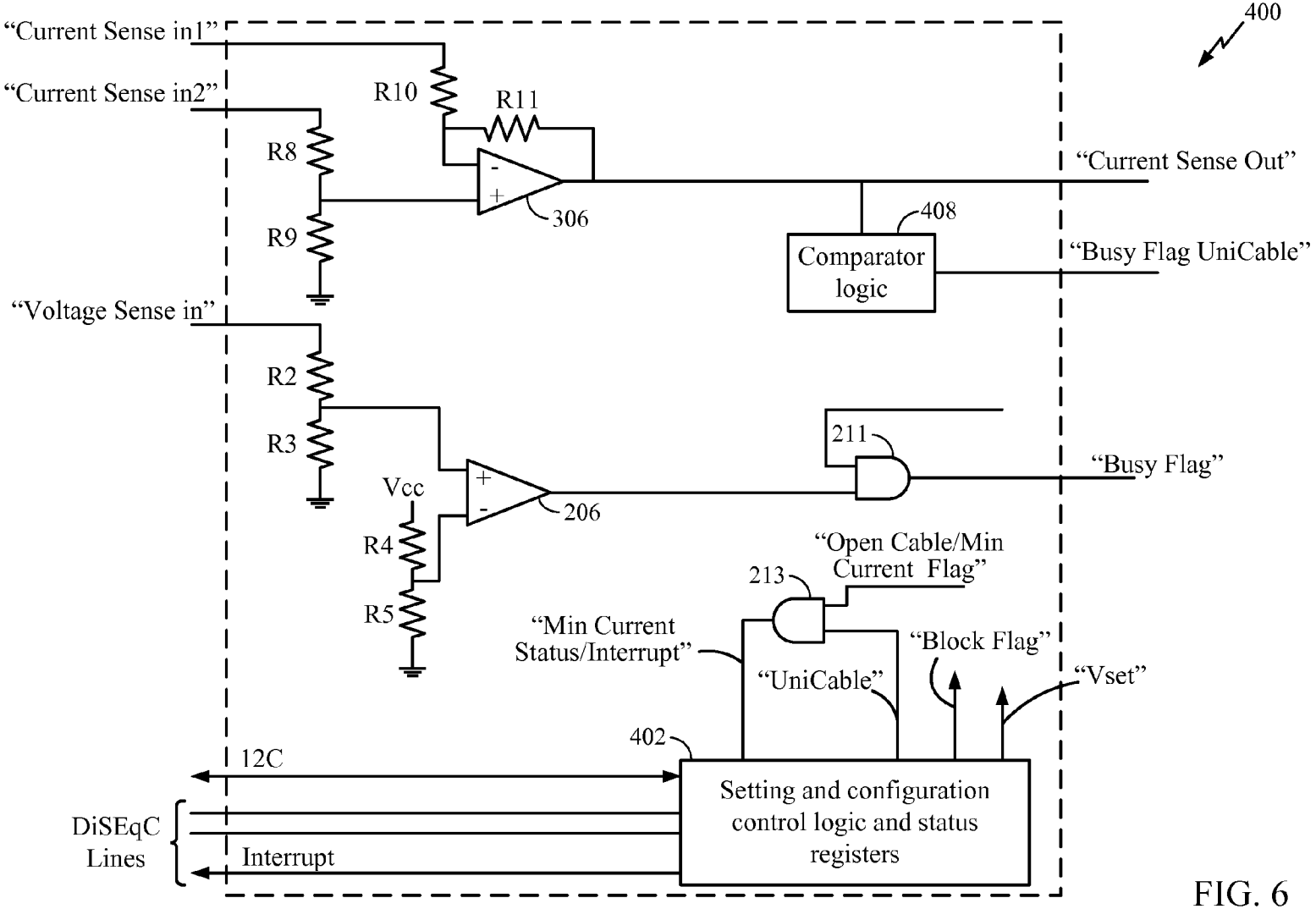
FIG. 6 illustrates a controller configured for sensing at least one parameter, in accordance with an exemplary embodiment of the present invention.

As noted above, functionality of the current sense and bleeding path circuits may be implemented within an LNB controller. For example, FIG. 6 illustrates a dual-mode LNB controller 400, according to an exemplary embodiment of the present invention. In this exemplary embodiment, controller 400 includes current sensing circuitry (i.e., resistors R8-R11 and differential amplifier 306). Inputs for the current sensing circuitry are depicted as "current sense in1" and "current sense in2". The output of differential amplifier 306, which is an analog voltage proportional to the current sense, may be conveyed to a digital demodulator auxiliary ADC as an example. The ADC may sample the current sense and the data is processed according to a method described below with relation to FIG. 8.

The output of differential amplifier 306 may also be routed to a comparator logic 408, which, based upon the current sensing voltage, asserts or de-asserts a "Busy Flag UniCable". It is noted that a comparator threshold can be configurable. Accordingly, controller 400 provides built-in current sensing and/or an analog current reading to digital demodulator chip for processing according to a method described below with relation to FIG. 8

Additionally, controller 400 includes a voltage sensing circuitry (i.e., resistors R2-R5 and comparator 206). An output of comparator 206 may be routed to AND gate 211 that serves as mask during transmission by applying "Block Flag" from control logic. The output of AND gate 211 is "Busy Flag" signaling a digital chip (SAT demodulator) that it may or may not send a DiSEqC command in UniCable mode. This information may be processed according to a method described below with reference to FIG. 9.

Further, controller 400 may be configured to prevent a minimum current error assertion while operating in UniCable mode. More specifically, during operation in UniCable mode, a UniCable configuration bit is set to "0", as an example, and thereby an AND gate 213 blocks the "Open Cable/Min Current Flag" resulting from the AND gate 213 output "Current Measurement" of current measurement process to propagate to the digital chip by an interrupt or via status bit error. As an example, the "UniCable" configuration bit is set to "1" in UniCable mode based on "Current Sense Out" measurement request when BUS is granted for ODU while performing gated current measurement and asserting "Current Test Gating Signal" or when checking if BUS is free by asserting Voltage to ODU. In both cases "Open Cable/Min Current Flag" fault alarm is prevented by masking it in UniCable configuration.

An IDU, which may include controller 400, may provide an ODU power via controller 400 or controller 400 may serve as serial data transmission interface to the ODU. This depends upon deployment strategy. In a case wherein controller 400 is used as power supply for the ODU in regular DiSEqC deployment, cable fault alarm "Open Cable/Min Current Flag" may be in use and be asserted as a result of current measurement bit output of the AND gate 213. In a case wherein controller 400 is an interface to the ODU in UniCable deployment, cable fault alarm "Open Cable/Min Current Flag" may be masked or ignored using the configuration bit "UniCable" and masking AND 213.

Figure 7:
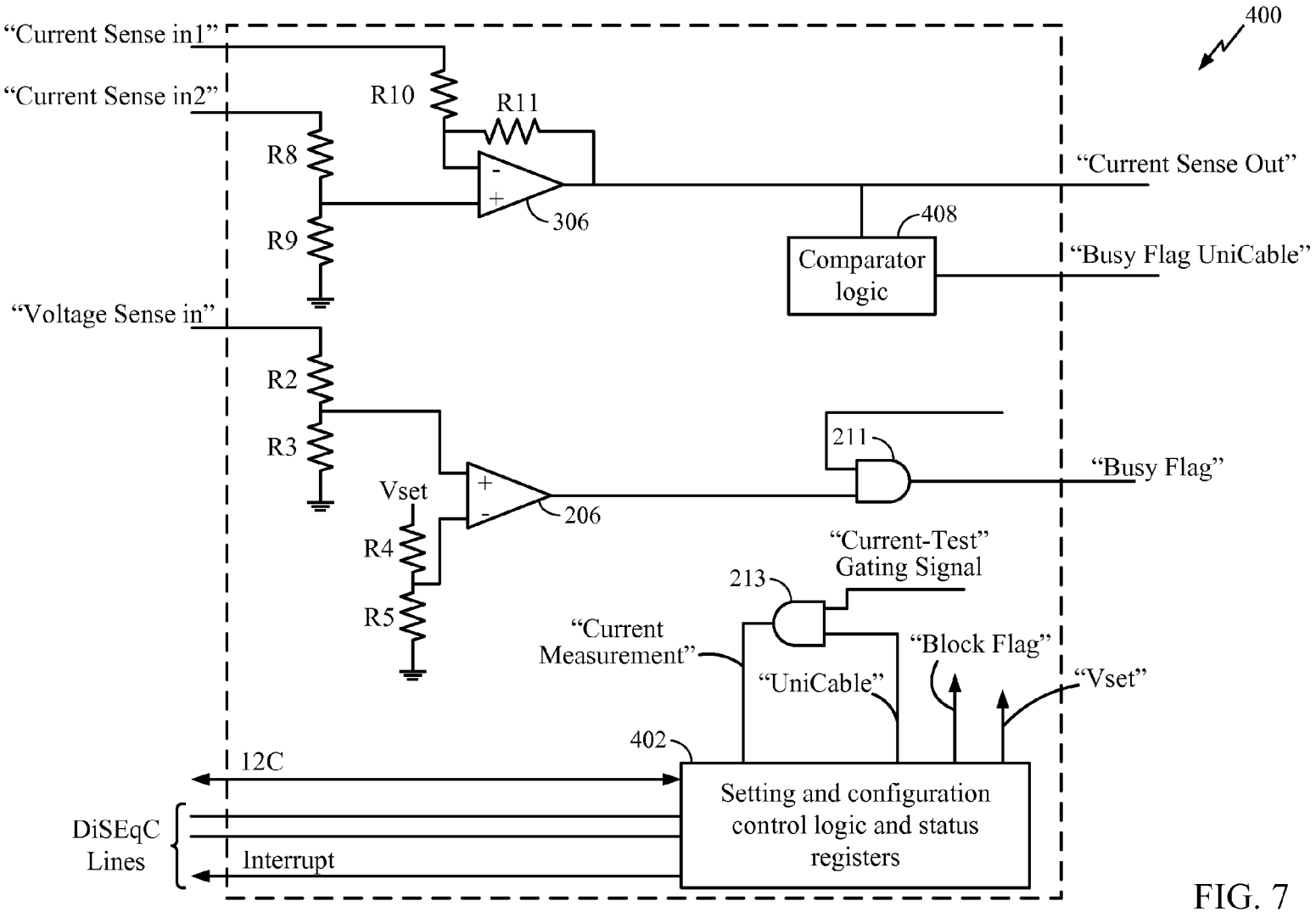
FIG. 7 is another illustration of a controller configured for sensing at least one parameter, according to an exemplary embodiment of the present invention.

Alternatively, a gated current measurement can be performed as illustrated in FIG. 7. Upon a voltage increase command to controller 400, setting and configuration logic 402 asserts a "Current Test Gating Signal" at an input of AND logic 213. Since the configuration is UniCable, "UniCable" signal is "1" and a "Current Measurement" signal is asserted and triggers a current measurement. As a result, an interrupt can be asserted to inform the digital chip controlling the LNB controller to start sampling the current value at the output of differential amplifier 306 via the ADC in the digital chip. The current test window is valid as long as the "Current Test Gating Signal" is asserted (e.g., at "1"). After the measurement is evaluated, the "Current Test Gating Signal" can be de-asserted and, based upon the current reading, controller 400 may decide whether or not to transmit. In a case where an ADC in the digital chip is note available, window comparators and logic within the comparator logic block may define if the current gradient is within a current threshold for determining whether to allow transmission of DiSEqC commands. Such indication can be reported to the digital chip either by interrupt or I2C status register read, or any other method such as "Busy Flag UniCable" signal, as an example. Although not illustrated in FIG. 6 or 7, controller 400 may further include circuitry for forming a current bleeding path from the anode of diode D5 to ground voltage GRND, as illustrated in FIGS. 3 and 4.

Figure 8:
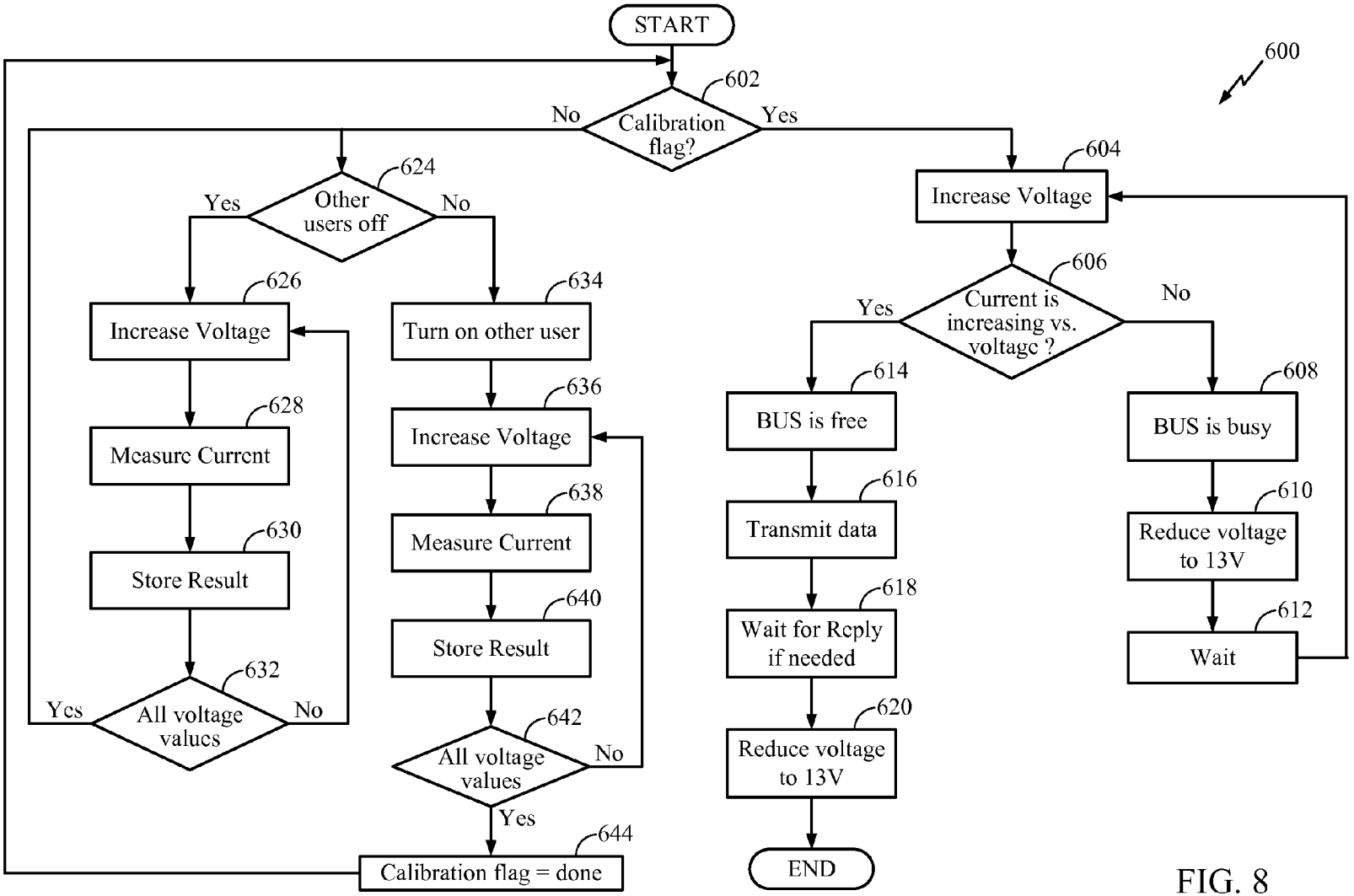
FIG. 8 is a flowchart illustrating a method, according to an exemplary embodiment of the present invention.

FIG. 8 is a flowchart illustrating a method 600, in accordance with one or more exemplary embodiments. Method 600 may include determining whether a calibration flag has been set (depicted by numeral 602). It is noted that the calibration flag will be set after a system has been calibrated. Thus, if the system is not yet calibrated, the calibration flag will not be set. If the calibration flag has been set, method 600 may include increasing a voltage (depicted by numeral 604). By way of example only, the voltage may be increased by 1 volt. Further, method 600 may include determining if a current is increasing with respect to the voltage (depicted by numeral 606). If the current is not increasing with respect to the voltage, a BUS is busy (depicted by numeral 608), and method 600 may include reducing the voltage (depicted by numeral 610). For example only, the voltage may be reduced to 13 volts. Further, method 600 may include waiting (depicted by numeral 612), and returning to step 604

Returning to step 606, if the current is increasing with respect to the voltage, the BUS is free (depicted by numeral 614), and method 600 may include transmitting data (depicted by numeral 616). Further, method 600 may include waiting for a reply, if needed (depicted by numeral 618). Method 600 may further include reducing the voltage (depicted by numeral 620). For example only, the voltage may be reduced to 13 volts.

Returning to step 602, if the calibration flag has not been set, method 600 may include determining whether other receivers are turned off (depicted by numeral 624). If other receivers are turned off, method 600 may include increasing the voltage (depicted by numeral 626). In addition, method 600 may include measuring the current (depicted by numeral 628) and storing the measured current result (depicted by numeral 630). For example only, the current may be measured at several voltages configured by the LNB controller from the lowest (e.g., 13 volts) to the highest (e.g., 18 volts) including cable loss compensation. Accordingly, a current gradient is mapped and stored. For example, current can be measured a 13.5 volts, 14.2 volts, 18.5 volts, and 20 volts. Moreover, method 600 may include determining whether all voltage values have been calibrated (depicted by numeral 632) and, if so, returning to step 602. If all voltage values have not been calibrated, method 600 returns to step 626.

Returning to step 624, if all other receivers are not turned off, method 600 may include activating another receiver (depicted by numeral 634) and increasing the voltage (depicted by numeral 636). Furthermore, method 600 may include measuring the current (depicted by numeral 638) and storing the measured current result (depicted by numeral 640). The current may be measured at several voltages configured by the LNB controller from the lowest (e.g., 13 volts) to the highest (e.g., 18 volts). Additionally, method 600 may include determining whether all voltage values have been calibrated (depicted by numeral 642). If all voltage values have not been calibrated, method 600 returns to step 636. If all voltage values have been calibrated, the calibration flag has been set and method 600 may return to step 602.

Figure 9:
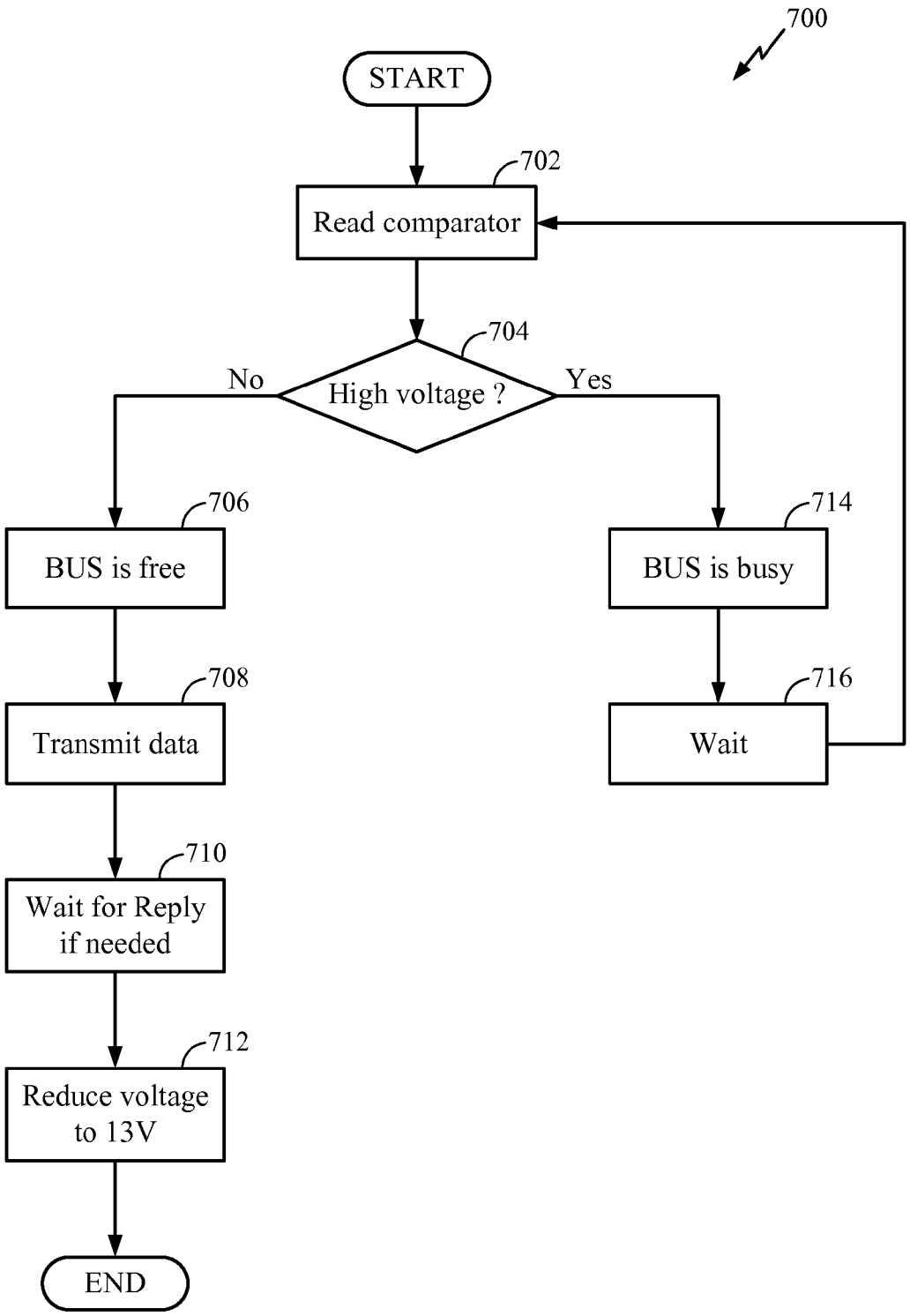
FIG. 9 is another flowchart illustrating a method, in accordance with an exemplary embodiment of the present invention.

FIG. 9 is another flowchart illustrating another method 700, in accordance with one or more exemplary embodiments. Method 700 may include comparing a measured voltage to a threshold voltage (depicted by numeral 702). If the measured voltage is greater than the threshold voltage, a BUS is free (depicted by numeral 704) and method 700 may include transmitting data (depicted by numeral 708). Further, method 700 may include waiting for a reply, if needed (depicted by numeral 710) and reducing the voltage (depicted by numeral 712). For example only, the voltage may be reduced to 13 volts. Returning to step 704, if the measured voltage is not greater than the threshold voltage, the BUS is busy (depicted by numeral 714) and method 700 may include waiting (depicted by numeral 716) and returning to step 702.

Figure 10:
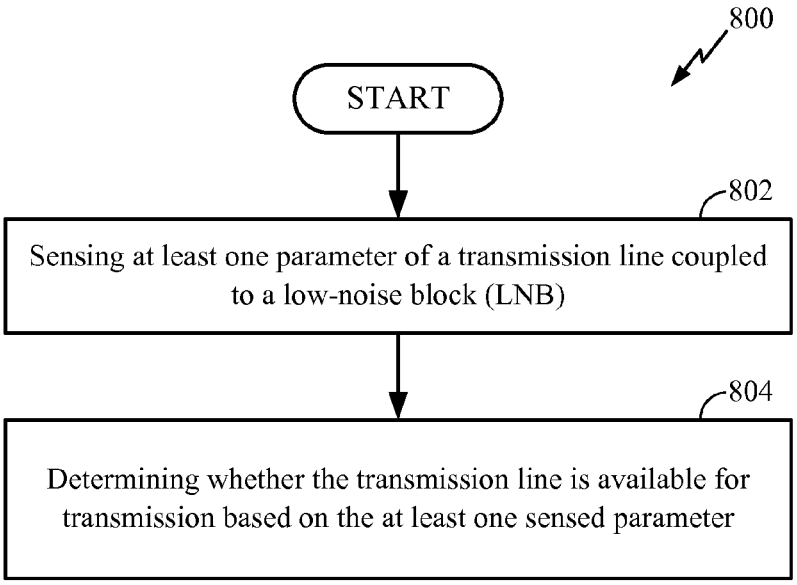
FIG. 10 is yet another flowchart illustrating a method, in accordance with an exemplary embodiment of the present invention.

FIG. 10 is another flowchart illustrating a method 800, in accordance with one or more exemplary embodiments. Method 800 may include sensing at least one parameter of a transmission line coupled to a low-noise block (LNB) (depicted by numeral 802). Method 800 may also include determining whether the transmission line is available for transmission based on the at least one sensed parameter (depicted by numeral 804).

Figure 11:
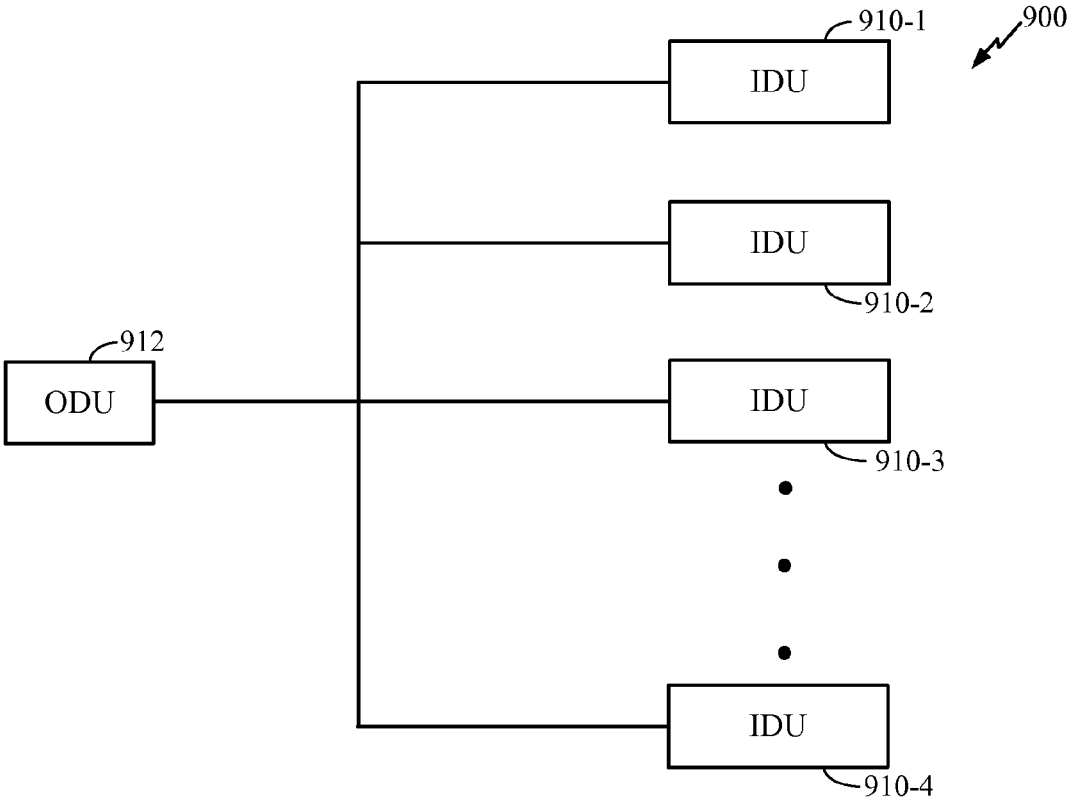
FIG. 11 is a block diagram of a system, according to an exemplary embodiment of the present invention.

FIG. 11 illustrates a system 900 including a plurality of indoor units (IDUs) 910-1-910-N coupled to an outdoor unit (ODU) 912. According to one exemplary embodiment, system 900 may include satellite communication system wherein ODU 912 is positioned outside of a structure (e.g., a house, a business, or a vehicle). In this exemplary embodiment, ODU 912 may include a satellite dish, a feedhorn, and a low-noise block (LNB). Further, each IDU 910 may include an indoor satellite TV receiver, a settop box, a personal computer (PC), a laptop computer, a media gateway, or any other device that can receive a feed from a satellite dish via a cable. As an example, system 900 may include up to eight IDUs. Further, one or more of IDUs 910, which may be configured to operate in a Digital Satellite Equipment Control (DiSEqC) mode and/or an UniCable mode based on a configuration setting, may include circuitry described above with reference to any of FIGS. 3-7.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the exemplary embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments of the invention.

The various illustrative logical blocks, modules, and circuits described in connection with the exemplary embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the exemplary embodiments shown herein but is to be accorded the widest scope consistent with the principles and novel features disclosed herein.

What is claimed is:

1. A receiver device, comprising:

a controller configured to convey a signal to a low-noise block (LNB) of an outside device via a transmission line, wherein the transmission line is coupled to the outside device and at least one other receiver;

a diode coupled to the transmission line;

circuitry coupled to a cathode of the diode and configured to sense at least one parameter of the transmission line, the circuitry comprising:

a plurality of resistors, and a differential amplifier;

logic coupled to the circuitry and configured to determine whether the transmission line is available for transmission before transmission of the signal by the receiver device, wherein the determination is based on the at least one sensed parameter and wherein the receiver device is configured to wait to attempt transmission of the signal until the transmission line is available for transmission;

a transistor coupled between an anode of the diode and including a gate configured to receive a control signal; and a resistor coupled between the transistor and a ground voltage.

2. The device of claim 1, wherein the transmission line is switchably coupled to a ground voltage via a resistor to form a current bleeding path while the at least one other receiver is transmitting.

3. The device of claim 1, wherein the circuitry comprises voltage sensing circuitry to sense a voltage, the voltage sensing circuitry comprising a voltage divider.

4. The device of claim 3, the logic configured to determine whether the transmission line is in use by another controller based on the sensed voltage.

5. The device of claim 1, wherein the circuitry comprises current-sensing circuitry to sense a current.

6. The device of claim 5, the logic configured to, when the receiver device is transmitting, detect a data collision with the at least one other receiver on the transmission line based on the sensed current.

7. The device of claim 6, the controller further comprising:

a receive port coupled to a cathode of the diode;

a transmit port; and an output voltage port coupled to an anode of the diode.

8. The device of claim 1, wherein the receiver device comprises one of:

a satellite television receiver, a settop box, a personal computer (PC), a laptop computer, and a media gateway.

9. The device of claim 1, wherein the controller is configured to operate in a UniCable mode based on a configuration setting.

10. A method, comprising:

sensing, by circuitry included in the receiver device, at least one parameter of a transmission line, wherein the circuitry comprises a plurality of resistors and a differential amplifier, the circuitry is coupled to a cathode of the diode, the diode is coupled to the transmission line, and the transmission line is coupled to an outside device and at least one other receiver;

determining, by logic coupled to the circuitry in the receiver device, whether the transmission line is available for transmission before transmission of a signal to a low-noise block (LNB) of the outside device by the receiver device via the transmission line, wherein the determining is based on the at least one sensed parameter;

waiting, by the receiver device, to attempt transmission of the signal until the transmission line is available for transmission; and conveying, by a controller included in the receiver device, the signal to the LNB of the outside device when the transmission line is available for transmission, wherein a transistor coupled between an anode of the diode includes a gate configured to receive a control signal and a resistor is coupled between the transistor and a ground voltage.

11. The method of claim 10, wherein sensing at least one parameter comprises sensing one of a voltage on the transmission line and a current through the transmission line.

12. The method of claim 10, wherein determining comprises comparing the at least one sensed parameter to a reference parameter.

13. The method of claim 10, wherein sensing comprises sensing a current through the transmission line after increasing a voltage on the transmission line.

14. The method of claim 13, wherein determining comprises determining whether the sensed current is increasing with respect to the increase in the voltage.

15. The method of claim 10, further comprising forming a current bleeding path by switchably coupling the transmission line to a ground voltage via a resistor.

16. The method of claim 10, further comprising:

storing measured current values at a plurality of voltages to calibrate the receiver device.

17. The method of claim 16, wherein storing measured current values at a plurality of voltages to calibrate the receiver device comprises:

defining a current threshold value for determining whether the transmission line is available for transmission.

18. A receiver device, comprising:

means for sensing at least one parameter of a transmission line, comprising:

a plurality of resistors and a differential amplifier, wherein the means for sensing is coupled to a cathode of the diode, the diode is coupled to the transmission line, and the transmission line is coupled to an outside device and at least one other receiver;

means for determining whether the transmission line is available for transmission before transmission of a signal to a low-noise block (LNB) of the outside device of the receiver device via the transmission line, wherein the determining is based on the at least one sensed parameter;

means for waiting to attempt transmission of the signal until the transmission line is available for transmission; and means for conveying the signal to the LNB of the outside device when the transmission line is available for transmission, wherein a transistor coupled between an anode of the diode includes a gate configured to receive a control signal and a resistor is coupled between the transistor and a ground voltage.

19. The device of claim 18, wherein the means for sensing at least one parameter comprises means for sensing one of a voltage on the transmission line and a current through the transmission line.

20. The device of claim 18, wherein the means for determining comprises means for comparing the at least one sensed parameter to a reference parameter.

* * * * *